United States Patent [19]

Wittwer

[11] Patent Number: 4,686,903

[45] Date of Patent: Aug. 18, 1987

[54] METHOD OF MANUFACTURING A POLE BODY FOR AN ELECTRIC FUSE, POLE BODY FOR AN ELECTRIC FUSE AND METHOD OF USING THE POLE BODY

[75] Inventor: Alfred Wittwer, Niederglatt, Switzerland

[73] Assignee: Ems-Inventia AG, Zürich, Switzerland

[21] Appl. No.: 725,960

[22] Filed: Apr. 22, 1985

[30] Foreign Application Priority Data

May 21, 1984 [CH] Switzerland ..... 2495/84

[51] Int. Cl.[4] ..... F42B 3/12

[52] U.S. Cl. ..... 102/202.5; 102/202.12; 102/202.14; 102/202.9; 427/106; 427/123

[58] Field of Search ..... 102/202.5, 202.7, 202.8, 102/202.9, 202.12, 202.14; 427/91, 97, 99, 106, 107, 124, 125, 123

[56] References Cited

U.S. PATENT DOCUMENTS

| | | | |
|---|---|---|---|
| 3,134,329 | 5/1964 | Zeman | 102/202.7 |
| 3,669,022 | 6/1972 | Dahn et al. | 102/202.7 X |
| 3,867,885 | 2/1975 | Gawlick et al. | 102/202.9 |
| 4,267,567 | 5/1981 | Nygaard et al. | 102/202.5 |
| 4,335,653 | 6/1982 | Bratt et al. | 102/202.9 X |
| 4,409,262 | 10/1983 | Jelks et al. | 427/124 X |
| 4,576,094 | 3/1986 | Meador | 102/202.7 X |

FOREIGN PATENT DOCUMENTS

| | | | |
|---|---|---|---|
| 2119907 | 11/1983 | United Kingdom | 102/202.5 |

*Primary Examiner*—Peter A. Nelson
*Attorney, Agent, or Firm*—Werner W. Kleeman

[57] ABSTRACT

The pole body for electric fuses comprises a homogeneous insulator in which a needle-shaped detonator pin is arranged normally to the plane of a metal layer which contacts a detonator charge on its opposite side. Due to the nearly point-shaped detonating bridge formed in the metal layer there occur, at the moment of detonation, very high current densities which cause melting of the detonating bridge. The pole body is manufactured from a glass tube surrounded by a metal tube. In order to prevent occlusion of gas in the insulator formed from the glass tube, a guiding body is placed upon the tip of the detonator pin which is part of a pole pin or of a pole cup during the melting operation. Preferably, the pole body is used in fuses with extremely short reaction times, for example, in ammunition, projectiles and the like.

18 Claims, 5 Drawing Figures

METHOD OF MANUFACTURING A POLE BODY FOR AN ELECTRIC FUSE, POLE BODY FOR AN ELECTRIC FUSE AND METHOD OF USING THE POLE BODY

BACKGROUND OF THE INVENTION

The present invention relates to a new and improved method of manufacturing a pole body for an electric fuze. The invention also relates to a new and improved construction of a pole body for an electric fuze.

In its more particular aspects the present invention specifically relates to a new and improved method of manufacturing a pole body for an electric fuze comprising at least two metallic poles which are separated from each other by means of a homogeneous insulator and which are electrically conductively interconnected at their end faces by a metal layer arranged in the region of a detonator charge. At least one of said poles forms a detonating bridge at a contact location with the metal layer.

In a pole body for an electric fuze as known, for example, from German Patent No. 2,840,738, the two poles project into a conducting metal layer and one of the poles is surrounded by a metal layer having an insulating gap or recess and which metal layer is in contact with a detonator charge. A planar metal surface acts as a detonating bridge between the ends of the gap. Such gap is frequently produced by the action of a laser beam.

In a further electric fuze as known, for example, from German Patent No. 2,816,300, the insulating body is made of glass. The glass and the poles of this electric fuze are solidly mechanically interconnected by fusing. This manufacturing method, however, is complicated and does not allow rapid and precise fabrication, particularly of very small pole bodies. Also in this case a detonating bridge is generated on a metal layer which is connected with the poles, by means of laser beams. Such thin metal layers constituting the detonating bridge represent a further development of the known detonating bridges formed by wires which contact the detonator charge throughout their entire length and ignite the detonator charge by glowing.

These known types of detonating bridges which are generated by means of laser beams have proven successful as a further development due to their planar structure in comparison to the ignition and glowing wires. However, they have the disadvantage that expensive apparatus is required for generating laser beams of sufficient intensity.

SUMMARY OF THE INVENTION

Therefore, with the foregoing in mind it is a primary object of the present invention to provide a new and improved method of manufacturing a pole body for an electric fuze which permits the rapid, economical and precise manufacture of the smallest and most compact possible pole bodies.

It is a further significant object of the present invention to provide a new and improved construction of a pole body for an electric fuze which can be rapidly, economically and precisely manufactured and has the smallest and most compact possible size.

Another important object of the present invention is to provide a new and improved construction of a pole body for an electric fuze which permits a high current density during operation.

Now in order to implement these and still further objects of the invention, which will become more readily apparent as the description proceeds, the manufacturing method of the present development is manifested by the features that, one of the poles, which may constitute a pole pin or a pole cup, is preformed with a substantially needle-shaped detonator pin. The preformed pole is inserted with play into a glass tube and the glass tube including the preformed pole is supported at a base plate. The glass tube including the preformed pole is then surrounded with play by a metal tube. Thereafter the glass tube is melted and thereby the preformed pole is fused into the material of the glass tube or body and into the metal tube.

It is an advantage of the inventive method that the preformed pole which may constitute a pole pin or a pole cup, can be fused in a bubble-free manner into the glass material of the glass tube in the interior of the metal tube.

According to a further development of the inventive method the detonator pin including the pole pin or the pole cup is loaded from above by means of a guiding or guide body of graphite prior to and during the melting operation. Such guiding body is heat-resistant. This has the advantage that during the collapse of the softening glass tube to form a glass melt this glass tube cannot conically collapse at its top region and that there is thus no occlusion of air. The rising glass melt urges the air towards the top until it has displaced the guiding body.

Preferably, the metal tube is held in a bore of a centering plate prior to and during the melting operation. This has the advantage that the centering plate insures for a vertical position of the metal tube. Thus, also the glass tube inserted into the metal tube is held in the correct position.

According to a further development of the inventive method a detonating plane of the pole body is ground off after the molten glass tube has cooled. This operation can be preformed in the position in which the pole body is still located at the base plate and held by means of the centering plate. It will be self-evident that, considering the small dimensions of the pole bodies, a greater number of pole bodies can be operated upon on one base plate; the last-mentioned pole bodies can be conjointly mounted at small distances at one centering plate. It is also believed to be self-evident that an endless band or the like can be used for the base plate.

Advantageously, the ground-off detonating plane or the ground-off detonating planes of the pole bodies can be directly provided in the aforementioned position with the metal layer and thereby the needle point shaped ends of the pole pins or pole cups are electrically connected with the annularly shaped end faces of the metal tubes. This step of the operation additionally simplifies the manufacture of the pole bodies and permits rapid fabrication of a greater number of pole bodies.

Advantageously, the fusing of the pole pin or pole cup including the detonator pin in the metal tube is conducted under a protective gas. It has been found to be favorable to use as the protective gas a protective welding gas like, for example, forming gas or any other suitable inert gas.

As alluded to above, the present invention is not only concerned with the aforementioned method aspects, but also relates to an improved construction of a pole body for an electric fuze. The pole body which is obtained according to the inventive method, contains a substantially needle-shaped metallic detonator pin which bears upon the metal layer and which is fused into an essentially bubble-free insulator.

Due to the at least approximately vertical position of the detonator pin relative to the metal layer there is obtained a nearly point-shaped contact area and thus also a very small detonating bridge. The current flows through the detonating bridge at a high current density, so that even small detonating energies of, for example, 30 micro-Watt-seconds and voltages of about 3 volts can result in very short reaction times of about 5 microseconds.

In a variant of the inventive pole body the one metal pole constitutes a pole cup and comprises a sleeve portion. This embodiment is space-saving as compared to an embodiment in which a pole pin is used instead of the pole cup. The metal layer or at least the detonating bridge and the tip of the detonator pin preferably are made of nickel, chromium, aluminum, palladium, gold, tantalum, rhenium, titanium, manganese or barium or an alloy of at least two of the aforementioned metals. Glass is used as the insulator because this has a relatively low melting point and can be gas-tightly connected to the bounding metal components. Advantageously a glass is preferred which has at least approximately the same expansion coefficient as the used metal.

It will be self-evident that the pole body and its components can be dimensioned within predetermined limits.

Preferably, the metal layer of the detonating bridge possesses a thickness in the range of about $1\times10^{-9}$ to about $2\times10^{-7}$ meters.

Advantageously, the electric resistance of the detonating bridge is in the range of about 0.1 to about 500 Ohms. The diameter of the entire pole body preferably is in the range of about 1.5 to about 20 mm. The diameter of the detonating bridge should be smaller than 0.8 mm.

The inventive pole body is particularly suited to be used in fuzes for detonating ammunition, such as projectiles, rockets, explosive charges and hollow charges.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
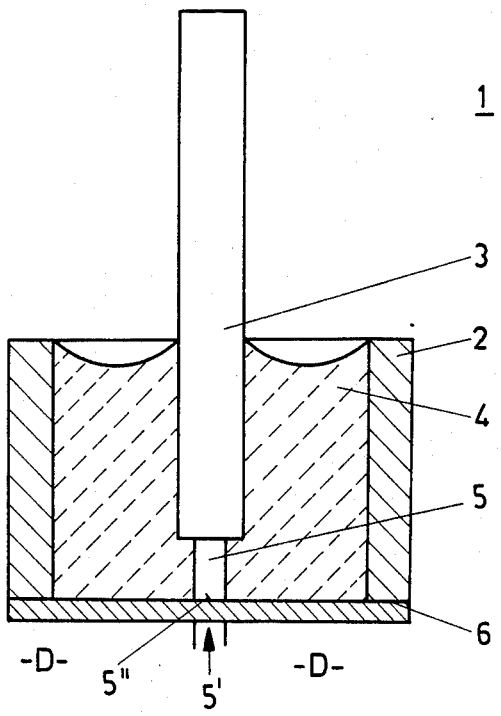
FIG. 1 is an axial section through a first embodiment of the inventive pole body.

Describing now the drawings, it is to be understood that only enough of the construction of the pole body and of the arrangement for manufacturing the pole body have been shown as needed for those skilled in the art to readily understand the underlying principles and concepts of the present development, while simplifying the showing of the drawings. Turning attention now specifically to FIG. 1, there has been shown an axial section through a first exemplary embodiment of the inventive pole body generally designated by reference character 1. Within a metal tube 2 which forms a housing, a pole pin 3, defining one of the poles of the pole body, is solidly connected to an essentially bubble-free insulator 4. In the portion which is embedded in the insulator 4, the pole pin 3 is drawn to a needle-shaped detonator pin 5 and forms a practically point-shaped detonating bridge 5' on a metal layer 6. An arrow points to the point-shaped area of the detonating bridge 5' in the metal layer 6. The needle point shaped end of the detonator pin 5 is designated by reference numeral 5''.

Figure 2:
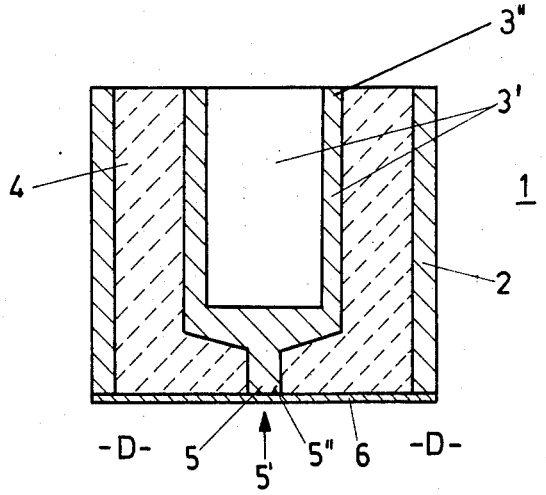
FIG. 2 is an axial section through a second embodiment of the inventive pole body.

FIG. 2 is an axial section through a second exemplary embodiment of the inventive pole body 1 and this second embodiment differs from the first embodiment illustrated in FIG. 1 primarily by the replacement of the pole pin 3 by a pole cup 3' which defines a sleeve portion 3''. The pole cup 3' has the function of one of the two conducting poles in the inventive pole body 1.

Figure 3:
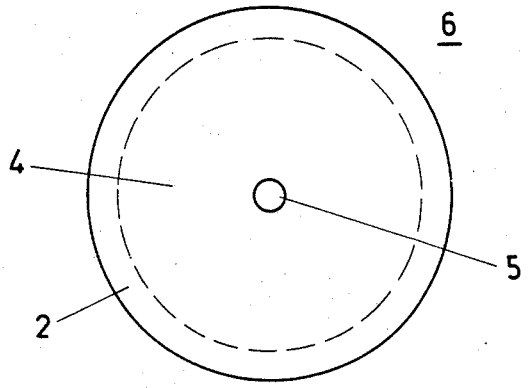
FIG. 3 is a top plan view of the metal layer with an indicated contact location in the pole body shown in FIG. 1 or in FIG. 2.

In the top plan view of the metal layer 6 shown in FIG. 3 the contact location of the detonator pin 5 is recognized as a surface area. The broken-line circle indicates an outer ring which is formed by the metal tube or housing 2 disposed below the metal layer 6. The insulator 4 is indicated by the central circular ring and is disposed below the metal layer 6. The metal tube of housing 2 and the metal layer 6 define the other pole of the pole body 1.

Figure 4:
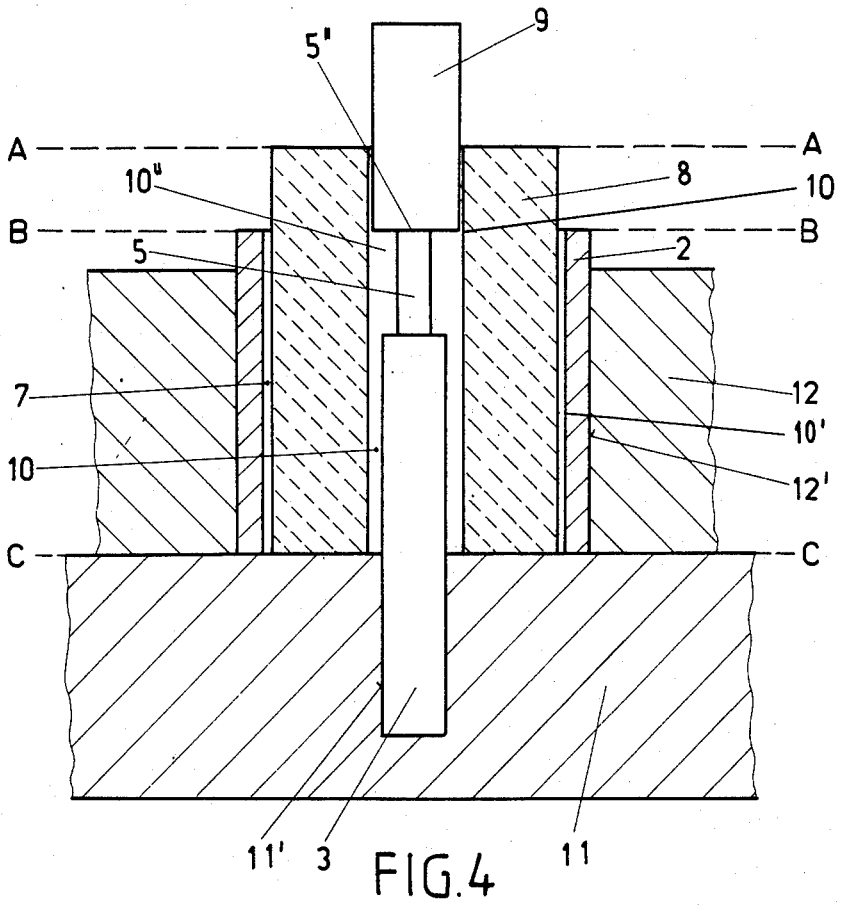
FIG. 4 is a vertical section of an arrangement for manufacturing the pole body illustrated in FIG. 1.

A first exemplary embodiment of the inventive method of manufacturing the pole body 1 illustrated in FIG. 1 will now be described with reference to FIG. 4 which illustrates in a vertical section an arrangement for manufacturing such pole body. Prior to the manufacturing operation the height or the top end of a glass tube 8 is placed in a plane A. A further plane B shows the state or position of a detonating plane defined by the pole body, after the manufacturing process.

Prior to the fabrication, the glass tube 8 is inserted or slid into a metal tube or housing 2 of a length which corresponds to the length of the manufactured pole body 1 and which is bounded by the planes B and C. The length of the glass tube 8 prior to the manufacturing operation corresponds to the distance between the top plane A and the plane or contact plane C. The pole pin 3 including the detonator pin 5 is mounted in the interior of the glass tube 8 and inserted into a bore 11' of a base plate 11 and thus is held in the correct position. The detonator pin 5 is loaded from above by means of a guiding or guide body 9 which is made of, for instance, graphite and the purpose of which has been described hereinbefore. The metal tube or housing 2 is mounted in a bore 12' of a centering plate 12.

Figure 5:
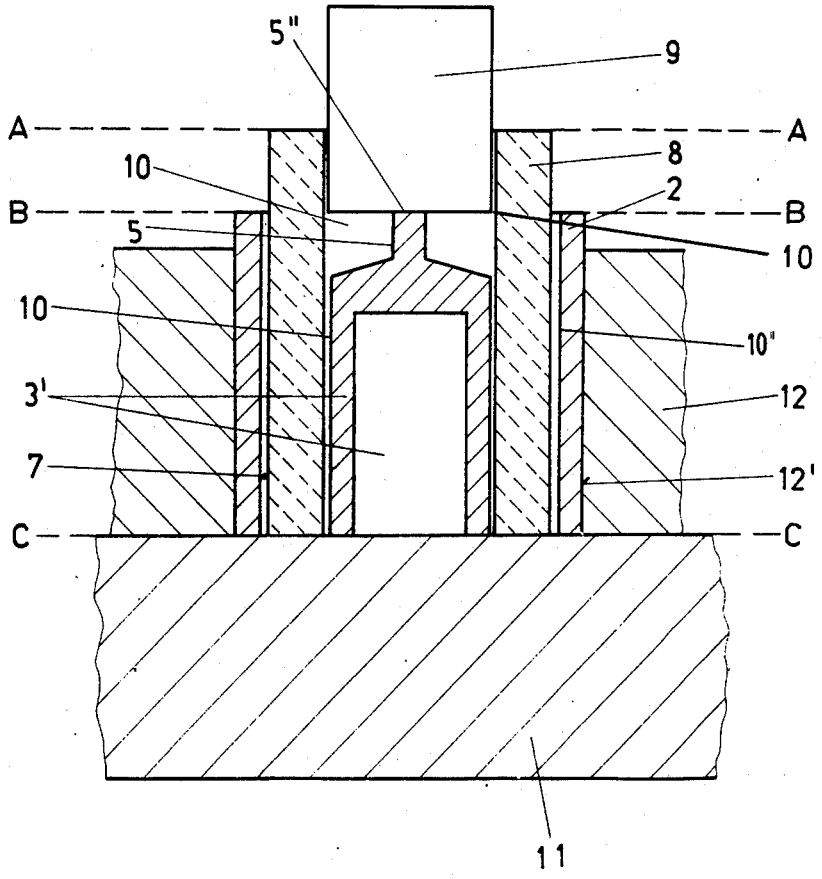
FIG. 5 is a vertical section of an arrangement for manufacturing the pole body illustrated in FIG. 2.

A second exemplary embodiment of the inventive manufacturing method will now be explained with reference to FIG. 5 which shows a vertical section through an arrangement for manufacturing the pole body 1 illustrated in FIG. 2. The pole pin 3 is replaced in this embodiment with the pole cup 3' which is located at the surface of the base plate 11. The remaining components in the arrangement illustrated in FIG. 5 correspond to the components shown in FIG. 4.

During the manufacture of the pole body 1 the metal tube or housing 2 is first cut-to-length in any suitable and known manner. The pole pin 3 or the pole cup 3' is drawn to form the detonator pin 5. The glass tube 8 has an outer diameter which is somewhat smaller than the inner diameter of the metal tube or housing 2, and is also cut-to-length and mounted at the base plate 11. Either the pole pin 3 or the pole cup 3' is inserted into the bore 11' of the base plate 11 or placed upon the base plate 11, respectively. The glass tube 8 defines a bore 10 and the guiding body 9 is pushed into this bore 10 from above. A hollow space 10' is also formed between an inner surface of the metal tube or housing 2 and the glass tube 8. Subsequently the workpiece which has been prepared in this manner, is fused in a belt or conveyor furnace in a temperature range of about 800° to about 1000° C. for about one hour under the aforementioned protective gas.

During the melting operation the glass softens and sinks under the action of gravity into the hollow space 10'' which is formed between the metal tube or housing 2 and the detonator pin 5 and into the hollow space 10' which is formed between the metal tube or housing 2 and the pole pin 3 or the pole cup 3'. In the liquid state the glass displaces the guiding body 9 towards the top. In this manner no gas bubbles can be occluded in the hollow spaces 10' and 10'' which are defined by the bore 10 of the original glass tube 8 which ultimately forms the insulator 4. The end of the melting operation can be recognized by a tilting movement of the guiding body 9 or by the emergence of the guiding body 9 from the hollow space 10''.

After the raw pole body thus formed is appropriately cooled, the raw pole body is ground off in the detonating plane B. The ground surface must have a fineness in the micrometer range. Finally, a metal or metal alloy is vapor-deposited at the ground surface under high vacumm.

At the detonating moment highest current densities appear at the detonating bridge 5' or the point-shaped contact location of the pole pin 3 or the pole cup 3' with the metal layer 6. The detonating bridge 5' melts and supplies the energy for the detonation of a detonator charge D which engages the metal layer 6 or is located in the region of the metal layer 6.

The inventive pole body 1 has the same advantages as a pole body which has been manufactured using a laser. However, the expensive laser installation is not required for its manufacture. Due to the fusion of the pole pin 3 or pole cup 3' which has been drawn to form the detonator pin 5, into the insulator 4 there is obtained an extremely high mechanical stability of the fuze.

The pole body can be very economically manufactured using glass as the insulator 4 without air bubbles being occluded in the insulator 4.

The inventive pole body 1 is used in electrical fuze devices for detonating ammunition like, for example, projectiles, hollow charges and the like with detonating times in the microsecond range.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of manufacturing a pole body for an electric fuze comprising at least two metallic poles which are separated from each other by means of a substantially homogeneous insulator and which are electrically conductively interconnected at their end faces by a metal layer arranged in the region of a detonator charge, one of said poles forming a detonating bridge at a contact location with said metal layer, said method comprising the steps of:

preforming one of said poles with a substantially needle-shaped detonator pin having a needlepoint shaped end;

inserting with play said preformed pole into a glass tube;

supporting said glass tube including said preformed pole at a base plate;

surrounding with play said glass tube including said preformed pole by a metal tube;

loading said preformed pole at an end remote from said base plate with a heat-resistant guiding body; and melting said glass tube and thereby fusing said preformed pole to the material of said glass tube and into said metal tube.

2. The method as defined in claim 1, further including the step of:

selecting as said one pole a pole pin.

3. The method as defined in claim 1, further including the step of:

selecting as said one pole a pole cup.

4. The method as defined in claim 1, further including the step of:

loading from above said preformed pole with said guiding body prior to and during said step of melting said glass tube.

5. The method as defined in claim 1, further including the step of:

holding said metal tube in a bore of a centering plate prior to and during said step of melting said glass tube.

6. The method as defined in claim 1, further including the step of:

grinding-off said pole body, after cooling of the molten glass tube, at least in a detonating plane of said pole body.

7. A method of manufacturing a pole body for an electric fuze comprising at leat two metallic poles which are separated from each other be means of a substanially homogeneous insulator and which are electrically conductively interconnected at their end faces by a metal layer arranged in the region of a detonator charge, one of said poles forming a detonating bridge at a contact location with said metal layer, said method comprising the steps of;

performing one of said poles with a substanially needle-shpaed detonator pin having a needlepoint shaped end;

inserting with play said preformed pole into a glass tube;

supporting said glass tube including said preformed pole at a base plate;

surrounding with play said glass tube including said preformed pole by a metal tube;

loading said preformed pole at an end remote from said base plate with a heat-resistant guiding body;

melting said glass tube and thereby fusing said preformed pole to the material of said glass tube into said metal tube;

grinding-off said pole body, after cooling of the molten glass tube, at least in a detonating plane of said pole body; and providing said ground-off detonating plane of said pole body with said metal layer and connecting said needlepoint shaped end of said needle-shaped detonator pin with an annularly shaped end face of said metal tube.

8. The method as defined in claim 1, wherein:

said step of melting said glass tube entails melting said glass tube under a protective gas.

9. The method as defined in claim 1, wherein:

said pole body is used in an electric fuze for detonating ammunition.

10. A pole body for an electric fuze, comprising:

at least two metallic poles;

a substantially homogeneous bubble-free insulator separating said at least two metallic poles from each other;

each one of said at least two metallic poles defining an end face;

a metal layer electrically conductively interconnecting said end faces of said at least two metallic poles;

one of said at least two metallic poles comprising a substantially needle-shaped metallic detonator pin bearing upon said metal layer at a contact location and forming a detonating bridge at said contact location;

said one metallic pole being fused into said substantially bubble-free insulator at least in the region of said detonator pin; and said metal layer being arranged in the region of a detonator charge.

11. The pole body as defined in claim 10, wherein:

said one metallic pole constitutes a pole pin provided with said needle-shaped detonator pin.

12. A pole body for an electric fuze, comprising.

at least two metallic poles;

a substanially homogeneous bubble-free insulator separating said at least two metallic poles from each other;

each one of said at least two metallic poles defining an end face;

a metal layer electrically conductively interconnecting said end faces of said at least two metallic poles;

one of said at least two metallic poles comprising a substanially needle-shaped metallic detonator pin bearing upon said metal layer at a contact location and forming a detonating bridge at said contact location;

said one metallic pole being fused into said substanially bubble-free insulator at least in the region of said detonator pin;

said metal layer being arranged in the region of a detonator charge; and said metallic pole constituting a pole cup forming a sleeve portion.

13. The pole body as defined in claim 10, wherein:

said metal layer possesses a thickness in the range of about $1\times10^{-9}$ to about $2\times10^{-7}$ meters in the region of said detonating bridge.

14. The pole body as defined in claim 10, wherein:

said detonating bridge possesses an electric resistance in the range of about 0.1 to about 500 Ohms.

15. The pole body as defined in claim 10, wherein:

said pole body possesses a diameter in the range of about 1.5 to about 20 mm.

16. The pole body as defined in claim 10, wherein:

said detonating bridge possesses a diameter smaller than 0.8 mm.

17. The pole body as defined in claim 10, wherein:

said substanially needle-shaped metallic detonator pin of said one metallic pole posessing a smaller size than the remainder of said one metallic pole.

18. The method as defined in claim 1, wherein:

said one pole is preformed such that said substanially needle-shaped detonator pin having said needlepoint shaped end is smaller in size then the remainder of said one preformed pole.

* * * * *